US010662024B2

(12) United States Patent
Kirkham

(10) Patent No.: US 10,662,024 B2
(45) Date of Patent: May 26, 2020

(54) TANGLE FREE CORD BAG

(71) Applicant: Jeffrey B. Kirkham, Draper, UT (US)

(72) Inventor: Jeffrey B. Kirkham, Draper, UT (US)

( * ) Notice: Subject to any disclaimer, the term of this patent is extended or adjusted under 35 U.S.C. 154(b) by 110 days.

(21) Appl. No.: 15/663,200

(22) Filed: Jul. 28, 2017

(65) Prior Publication Data

US 2018/0029826 A1 Feb. 1, 2018

Related U.S. Application Data

(60) Provisional application No. 62/368,718, filed on Jul. 29, 2016.

(51) Int. Cl.

| | |
|---|---|
| ***B65H 75/36*** | (2006.01) |
| ***B65D 33/28*** | (2006.01) |
| ***B65D 33/25*** | (2006.01) |
| ***B65D 33/24*** | (2006.01) |

(52) U.S. Cl.

CPC ..... *B65H 75/364* (2013.01); *B65D 33/24* (2013.01); *B65D 33/25* (2013.01); *B65D 33/28* (2013.01); *B65H 75/362* (2013.01); *B65H 2701/34* (2013.01)

(58) Field of Classification Search

CPC .... B65H 57/18; B65H 75/362; B65H 75/364; B65H 2701/34

See application file for complete search history.

(56) References Cited

U.S. PATENT DOCUMENTS

| | | | | |
|---|---|---|---|---|
| 6,085,695 A * | 7/2000 | Miller | A01K 27/006 | 119/795 |
| 8,789,696 B2 * | 7/2014 | Imburgia | B65H 57/18 | 206/388 |
| 2009/0050502 A1 * | 2/2009 | Garson | D04B 3/06 | 206/388 |

OTHER PUBLICATIONS

"Cord Warden "How to use your Cord Warden"." *YouTube*, uploaded by Amber Imburgia, Nov. 19, 2015, https://www.youtube.com/watch?v=JHnptxPCpuQ. Accessed Jul. 19, 2017.

* cited by examiner

*Primary Examiner* — Steven A. Reynolds
*Assistant Examiner* — Javier A Pagan
(74) *Attorney, Agent, or Firm* — Workman Nydegger

(57) ABSTRACT

Bags and bag assemblies are provided for facilitating tangle-free storage of cords, ropes, cables, and other long and flexible members within the bags and bag assemblies. The body of the bag includes two compartments which are at least partially separated from each other by an internal divider. Each of the two compartments include outer surfaces which define respective openings that each include a closing mechanism for selectively switching between an open and closed configuration. The internal divider is positioned directly between the two openings, and the bag is configured to provide access to the cord in the bag from either of the openings.

11 Claims, 10 Drawing Sheets

TANGLE FREE CORD BAG

CROSS-REFERENCE TO RELATED APPLICATIONS

This claims the benefit of and priority to U.S. Provisional Patent Application Ser. No. 62/368,718 filed on Jul. 29, 2016, and entitled "TANGLE FREE CORD BAG,", and which application is expressly incorporated herein by reference in its entirety.

BACKGROUND

1. Technical Field

The disclosure of this application generally relates to bags used to store cords, ropes, cables, and string, especially bags that are meant to store a portion of the cord and allow a portion of the cord to be smoothly removed.

2. Relevant Technology

Cords, ropes, cables, and other long and flexible members are used in a plethora of fields, including construction, electronics, recreation, medical, military, and other fields. Because of the long and flexible nature of cords, such members often become inadvertently tangled during storage, deployment, or use. Cord tangling often occurs when an end of the cord is allowed to intertwine with the body of the cord. When cords become tangled, their utility in their applicable field is stifled, which may lead to general inefficiency or potentially dire consequences (e.g., in the search-and-rescue field).

Various cord storage systems and apparatuses exist, including bags, buckets, and reel systems. These systems and apparatuses developed, at least in part, to address the problem of cord tangling. Many of these solutions, however, give rise to other problems. Many cord bags require tedious processes in order to store a cord in a tangle-free manner. For example, some cord bags require users to feed the entire cord to be stored by hand through a sleeve which leads into the compartment of the cord bag, which proves especially problematic for long cords. Reel systems allow for quicker tangle-free cord storage, but introduce other problems. For example, reel systems typically only allow removal and access to one end of the stored cord, not both. This problem also exists in many cord storage bags.

Furthermore, existing cord storage systems for tangle-free cord storage typically lack quick-deployment functionality. In particular, to unravel a reel system, an end of the stored cord needs to be pulled continuously, or the system needs to be rotated continuously to effectuate deployment. Further, cord storage bags typically are not configured to allow for quick deployment, and those that do allow for quick deployment only allow cord access and removal of one end of the cord from one opening in the bag. Some cord bags include internal anchors to prevent tangling, but the anchors themselves preclude quick deployment functionality.

Accordingly, there exists a need in the art for an improvement to cord storage bags that allows for efficient tangle-free cord storage without giving rise to limited access to the cord, limited deployment functionality, and other problems.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In some embodiments, a cord bag is configured for storing and removing a cord. The bag includes a bag body, which composes two compartments which are at least partially separated from each other by an internal divider. Each of the two compartments include outer surfaces which define respective openings that each include a closing mechanism for selectively switching between an open and closed configuration. The internal divider is positioned directly between the two openings, and the bag is configured to provide access to the cord in the bag from either of the openings.

In other embodiments, a cord bag, configured for storing and removing a cord, includes a bag body. The bag body includes a first compartment and a second compartment, and the first compartment is completely separated from the second compartment by an internal divider except for an expandable hole that passes through the internal divider. The expandable hole is expandable with a cinch cord. The first compartment includes an outer surface which defines a first opening, and the second compartment includes an outer surface which defines a second opening. The first and second openings are configured with cinch cords for selectively switching the first and second openings between an open configuration and a closed configuration. The internal divider is positioned such that it is axially aligned with an axis passing through the first opening and the second opening. The bag is configured to provide access to a cord in the bag from the first and second openings.

In yet other embodiments, a bag and cord assembly for storing and removing cord includes a bag body, which composes a first compartment and a second compartment. The first compartment is completely separated from the second compartment by an internal divider except for an expandable hole that passes through the internal divider. An outer surface of the first compartment defines a first opening in the first compartment, and an outer surface of the second compartment defines a second opening in the second compartment. The first and second openings include a closing mechanism for selectively switching the first and second openings between an open configuration and a closed configuration. The expandable hole in the internal divider is axially aligned with an axis passing through the first opening and the second opening.

The bag and cord assembly, in some embodiments, also includes a cord, which passes through the expandable hole in the internal divider. A portion of the cord is contained at least partially within the first compartment, and a portion of the cord is contained at least partially within the second compartment.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered limiting in scope, embodiments will be described and explained with additional specificity and detail through the use of the accompanying drawings in which.

DETAILED DESCRIPTION

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments, and is not necessarily intended to limit the scope of the claimed invention.

Existing tangle-free cord storage systems and apparatuses give rise to limited cord access, limited deployment functionality, tedious storage processes, and other problems. Aspects of the disclosed embodiments relate to a cord bag configured to allow opposite ends of a cord to be removed and accessed from a container without tangling the cord. Aspects of the disclosed embodiments also relate to cord bags that allow for tangle-free cord storage without restricting quick-deployment functionality and/or ease of storage.

The cord bags of the present disclosure include a bag with an opening on either end of the bag and a divider positioned within the body of the bag between the openings on either side of the bag. The cord bag is configured to store a length of cord. The cord bag may hold the cord in such a way that the cord may be freely pulled from either opening without tangling. Although the embodiment shown in FIG. 1 through FIG. 12 illustrates an extension cord, and the following description primarily concerns extension cord storage and access, other embodiments may include any type of cord, cable, line, lead, twine, string, filament, or any other long, flexible member. By way of non-limiting example, other embodiments may include a rescue rope, climbing and rappelling rope, detonation cord used in police and military operations, or fuse line used with explosives. Furthermore, the cord and the cord bag may be any size relative to each other.

Figure 1:
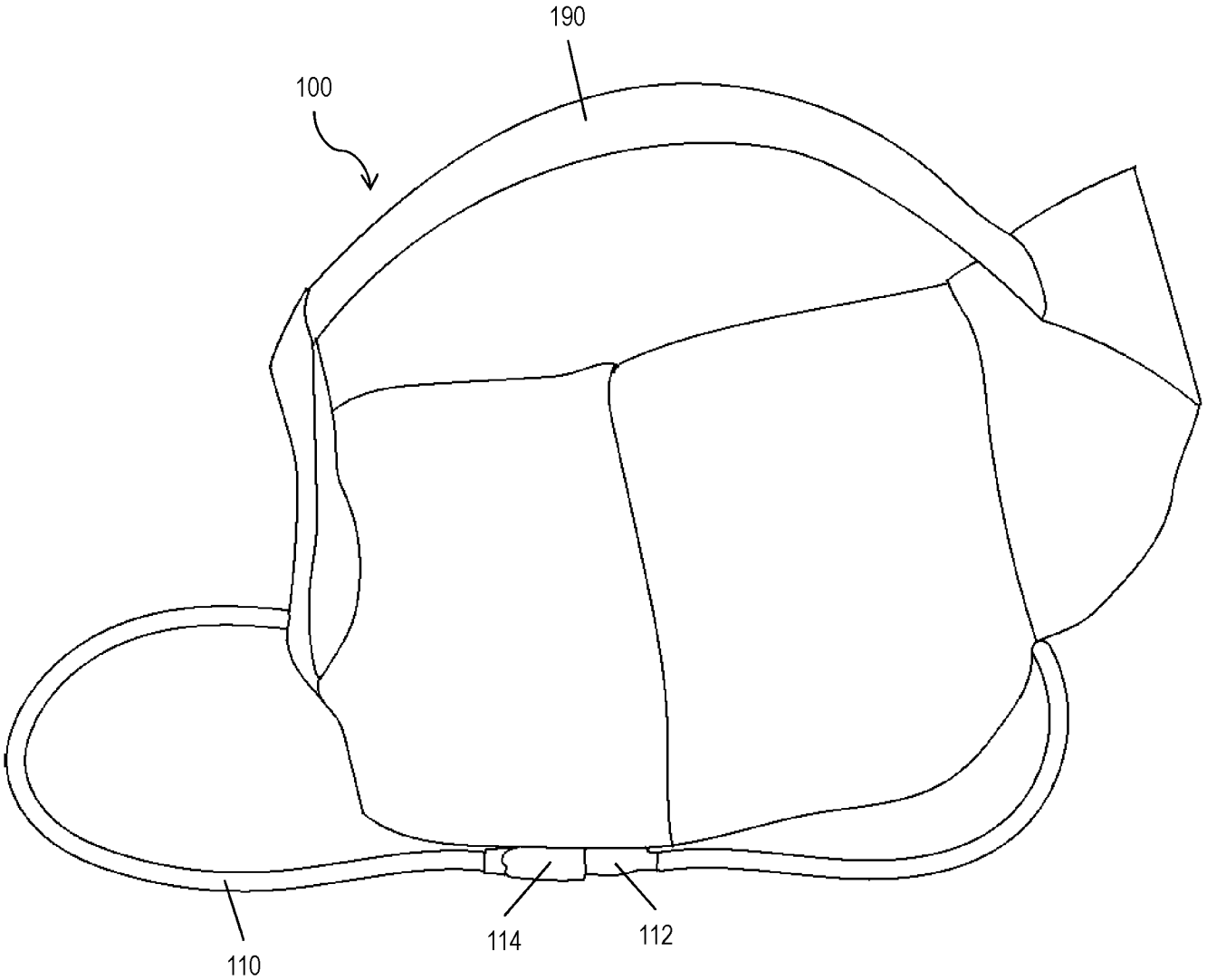
FIG. 1 illustrates an embodiment of a cord bag with a cord fully contained in the bag.

FIG. 1 illustrates a cord bag 100 which may be used for storing and removing cord. The cord bag 100 holds a length of a cord 110, which, as illustrated with the present embodiment, is an extension cord. The extension cord 110 has a first end 112 and a second end 114, which extend from opposite sides of the cord bag 100. As shown, the cord bag 100 includes a handle or strap 190 attached to the cord bag 100. In some embodiments, the handle or strap 190 extends from one end to the other end of the cord bag 100. In other embodiments, the handle or strap 190 is located between either end of the cord bag 100.

The cord bag 100 may be manufactured from a variety of materials. In some embodiments, the cord bag 100 is manufactured from a hard material, such as a plastic, steel or wood. In other embodiments, the material may include a pliable material, such as nylon, canvas, cotton, high-density poly-ethylene (HDPE), or other pliable material. Still other embodiments may include a combination of materials. For example, the cord bag 100 can be composed of a plastic cylinder (e.g., bucket) that is configured with a nylon cover. In other examples, a canvas bag is configured with a divider formed from wood, plastic and/or material. An additional non-limiting example includes a steel can with a plastic cover.

As depicted in FIG. 1, the first and second ends 112 and 114 of the extension cord 110 are joined together outside of the cord bag 100. In some embodiments, the joined-end configuration, as illustrated, is the primary configuration for storing the extension cord 110 in the cord bag 100 to keep the ends 112 and 114 from intertwining with the rest of the extension cord 110. In other embodiments, however, one or both of the ends 112 and 114 of the extension cord 110 are fastened to the cord bag. For example, one or both of ends 112 and 114 may be attached to a fastener (e.g., a loop, clasp, hook and loop connector strap, or plastic clamp adapted to hold an end of the extension cord 110—presently illustrated as Velcro fastener 250) on either side of the cord bag or any other portion of the bag to keep the ends 112 and 114 from intertwining with the rest of the extension cord 110. Such a fastener may be positioned on an inside or outside surface of the cord bag 100, or may be attached to the handle 190. Storing the extension cord 110 in the cord bag 100, whether by joining the ends 112 and 114 of the extension cord 110 together or by fastening the ends 112 and 114 to a part of the cord bag 100, also serves to prevent premature removal of the cord 100 from the cord bag 100.

In some embodiments, the cord bag 100 also includes a power strip (not presently shown), which power strip may operate as an extension to the cord (in series) and/or as a hub for a plurality of different electrical components, including the extension cord 110. In some embodiments, the power strip may be integrally attached to the cord bag 100. In other embodiments, the power strip may form at least a portion of the handle 190 of the cord bag 100 and/or be secured to the cord bag 100 with a flap, pocket, strap or other containment component attached to the cord bag 100.

Figure 2:
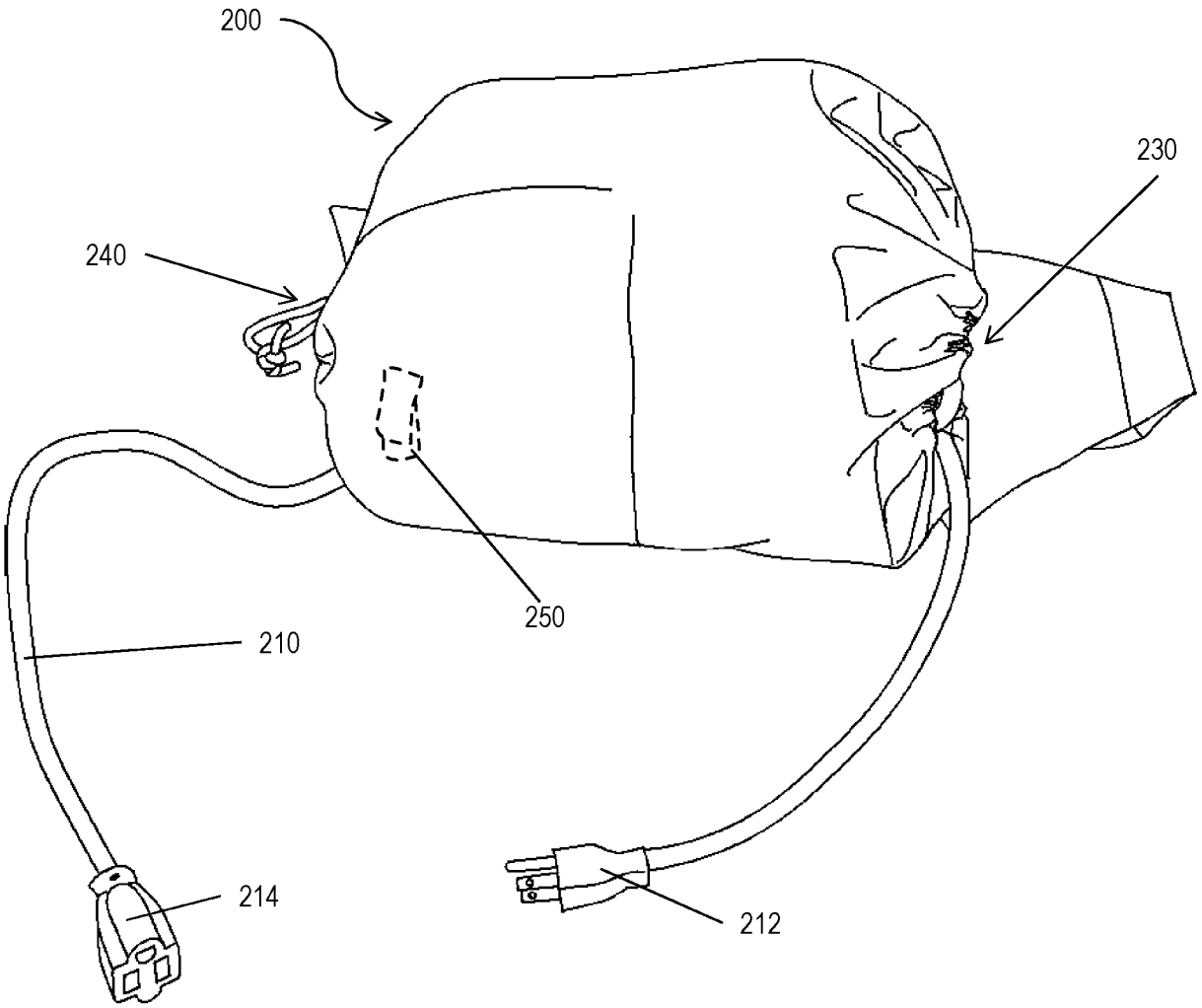
FIG. 2 illustrates another embodiment of a cord bag with a cord fully contained in the bag.

Referring to FIG. 2, the cord bag 200 includes a plurality of openings. As illustrated, the cord bag 200 includes a first opening 230 and a second opening 240. End 212 of the extension cord 210 extends from the first opening 230, and end 214 of the extension cord 210 extends from the second opening 240. The first and second openings 230 and 240 provide both an insertion location and a removal location for the extension cord 210.

Figure 3:
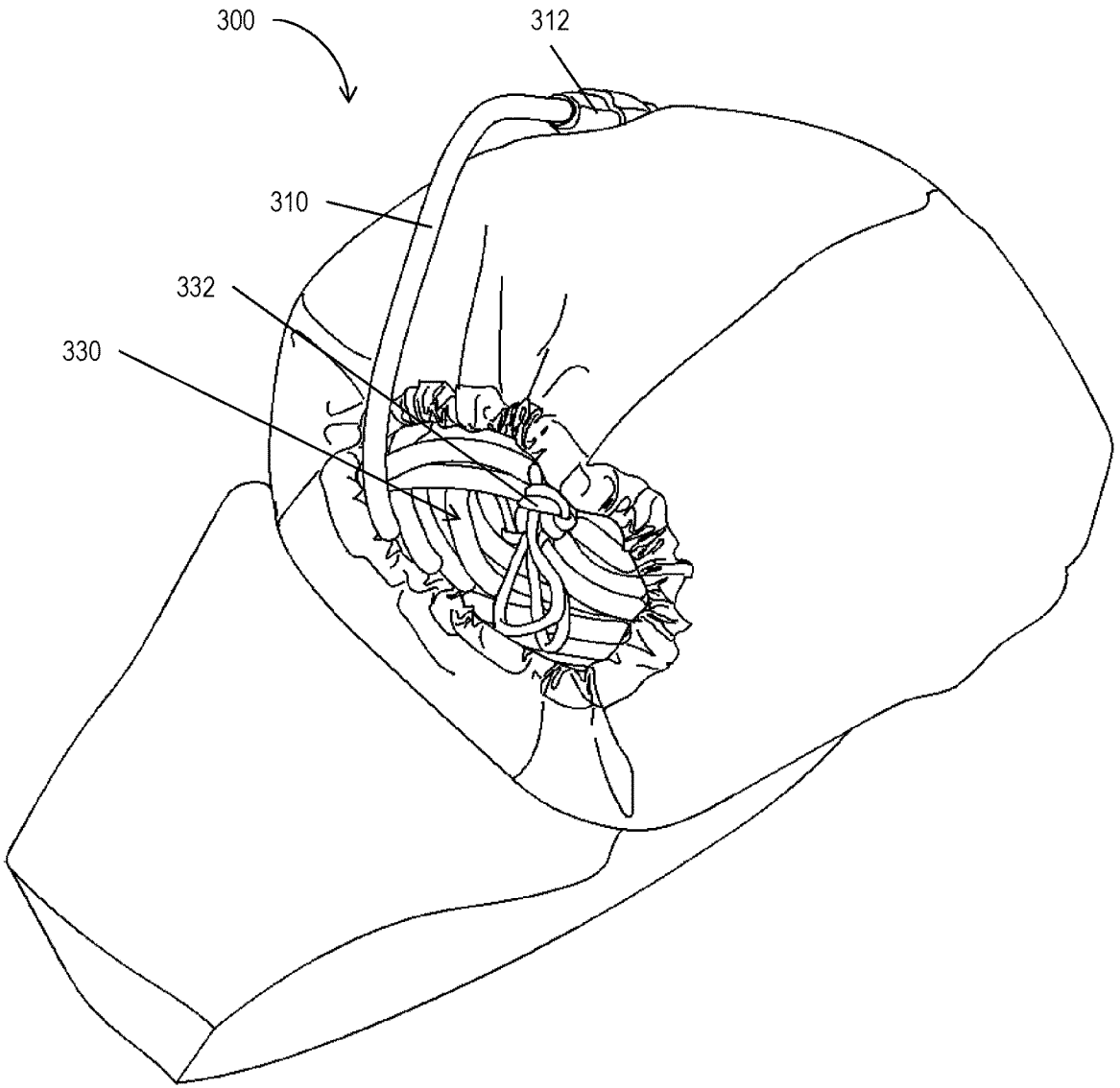
FIG. 3 illustrates cord bag with an opening.
Figure 4:
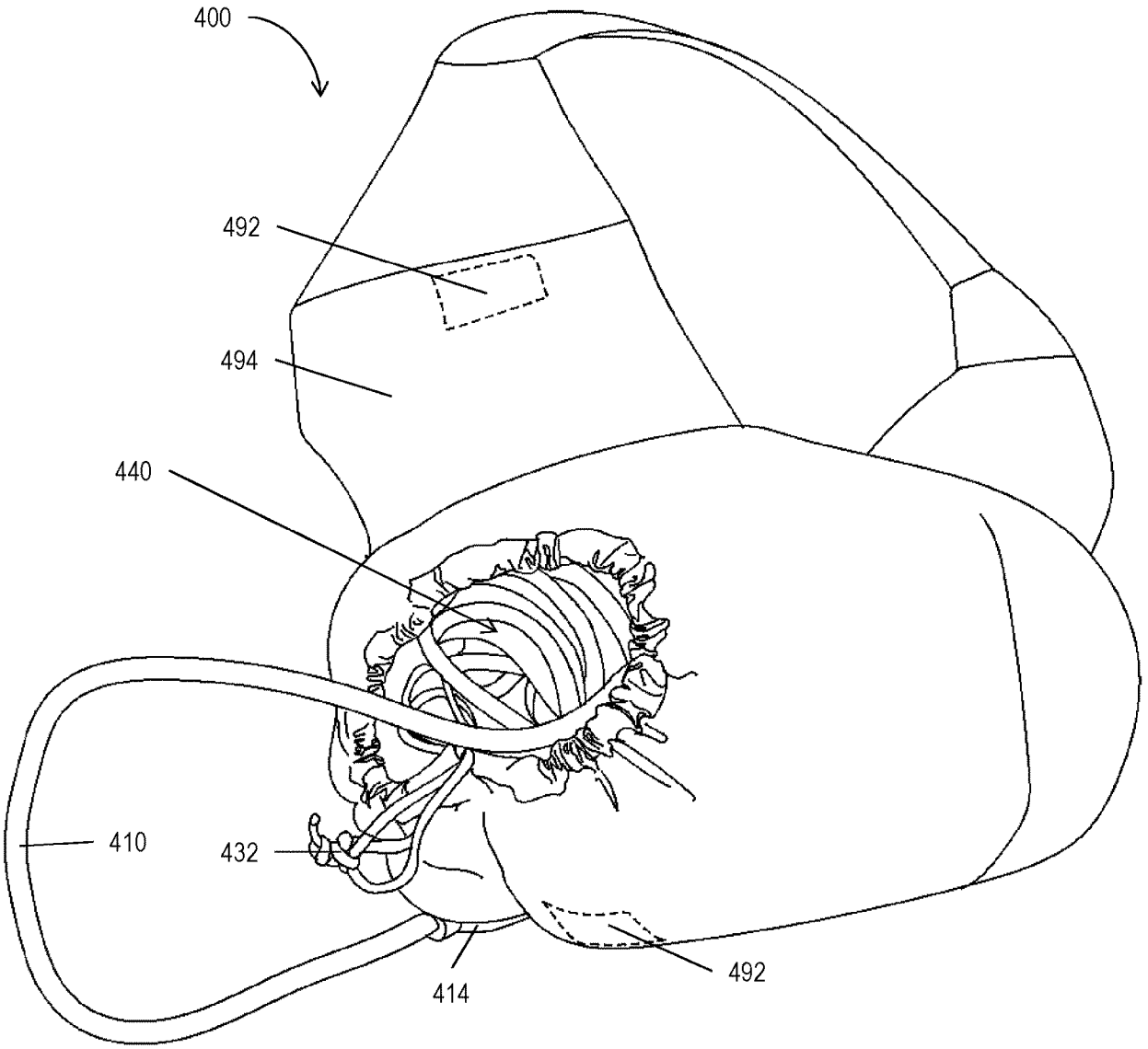
FIG. 4 illustrates the cord bag of FIG. 3, illustrating another opening of the cord bag.

FIG. 3 and FIG. 4 illustrate side views of the cord bag to demonstrate an exemplary embodiment of the first and second openings 330 and 440, respectively. FIG. 3 illustrates the first opening 330 of the cord bag 300 with the first end 312 of the extension cord 310 extending therefrom. As depicted, the first opening 330 is opened and closed using a draw string 332 (or cinch cord), and the size of the first opening 330 may be adjusted with the draw string 332. Similarly, FIG. 4 illustrates the second opening 440 of the cord bag 400 with the second end 414 of the extension cord 410 extending therefrom. As portrayed, the second opening 440 is opened and closed using a draw string 432, and the size of the first opening 330 is adjustable with the draw string 432.

It will be appreciated that the opening and closing mechanism utilized in first and second openings 330 and 440 is not limited to draw strings or cinch cords. By way of non-limiting example, the first and second openings 330 and 440 may be closable and openable using hook and loop connectors, such as Velcro connectors. In other embodiments, the openings may be closable with a folding portion of the material that comprises the cord bag 300, such as those used to create a water-tight seal. Additional embodiments may include a zippered opening, in which a zipper is used to close an opening from one side of the opening to the other. Another zippered opening could include two zippers that meet in the middle, or any other zipper configuration.

Those skilled in the art will furthermore recognize that the same opening and closing mechanism need not be used in both the first opening 330 and the second opening 440. For example, the first opening 330 may be adjustable with a zipper configuration, while the second opening 440 may be openable and closable with an adjustable rigid plastic partition element.

In some embodiments, cord bag 400 includes a Velcro connector 492 connected to a flap 494 and to the body of the bag to prevent premature removal of the cord 410 from the opening 440. Although a Velcro connector 492 is used in the illustrated embodiment, any hook and loop or other connector may be used to cover the opening 440 with a flap 494 or other partitioning means.

Figure 5:
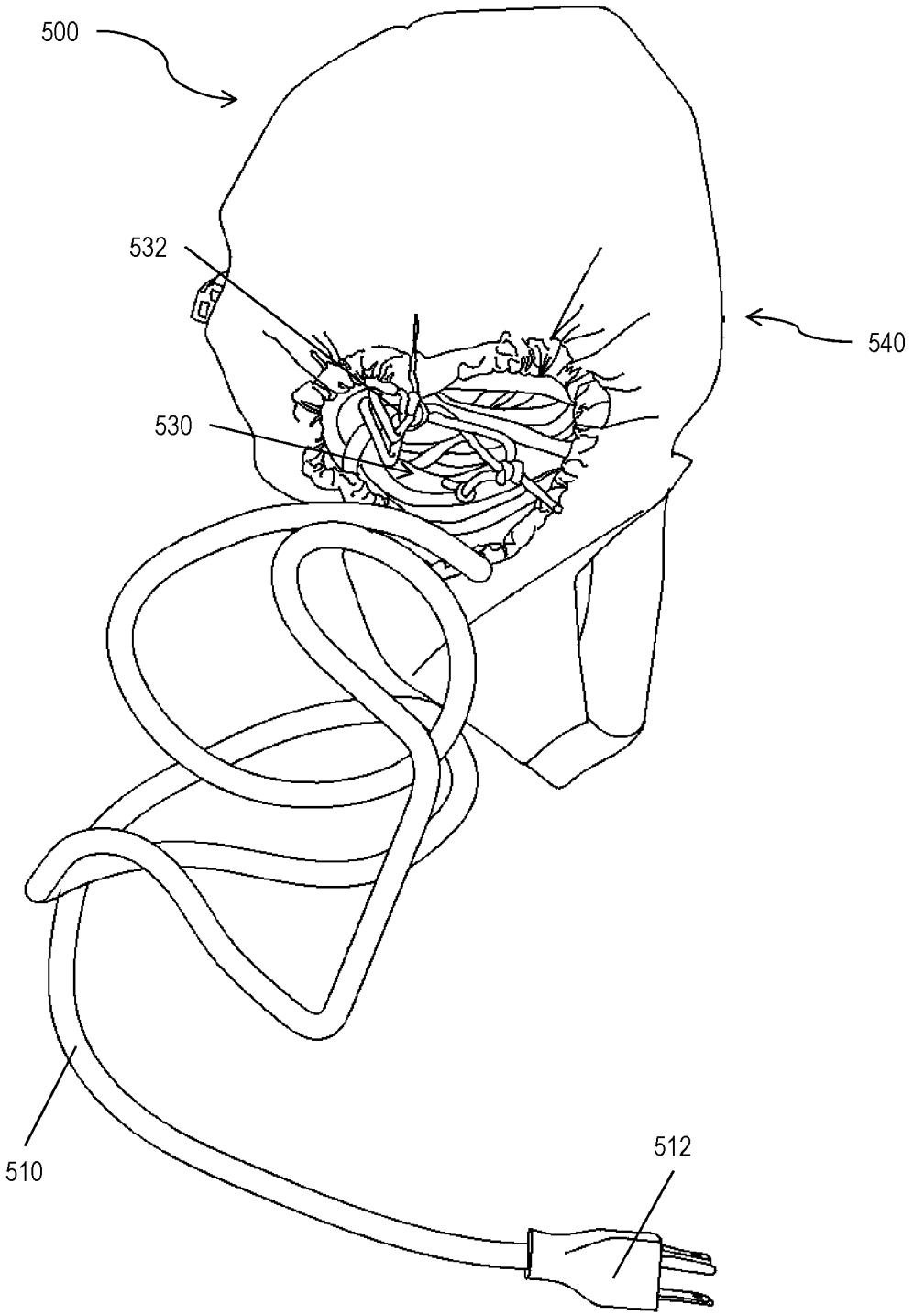
FIG. 5 illustrates a cord bag with an opening through which a cord is partially removed.

Either end of the extension cord may be accessed and/or removed from a respective opening in the cord bag. FIG. 5 shows a side view of the cord bag 500, and illustrates the opening 530 of the cord bag 500 through which an end 512 and portion of the extension cord 510 extends. Another portion of the extension cord 510 remains inside of the cord bag 500. The depicted configuration illustrates that a user may draw the end 512 of the extension cord 510 through the opening 530, while leaving at least part of the extension cord 510 inside of the cord bag 500. The extension cord 510 may be stored in the cord bag 500 in a series of stacking loops, such that when the extension cord 510 is drawn through the opening 530 the cord does not tangle. Additionally or alternatively, the extension cord 510 may be stored in the cord bag 500 in a series of random coils, which may be randomly oriented, and stacked to allow the extension cord 510 to draw through the opening 530 without tangling.

Because the size of opening 530 is adjustable by the opening and closing mechanism (implemented in FIG. 5 as a draw string 532), the user may use a process of their choice for preparing the extension cord 510 for placement within the cord bag 500 through the opening 530 (e.g., coiling, looping and/or stacking the extension cord 510 by hand or by other means) before placing the extension cord 510 in the cord bag 500 through the opening 530. This functionality (user freedom to choose the process for preparing the extension cord 510 for storage within the cord bag 500) provides for quicker and/or more efficient tangle-free storage of an extension cord in a cord bag, thus allowing users to avoid tedious loading processes required by other cord storage bags.

In some embodiments, the opening 530 may be partially open when drawing the extension cord 510 through the opening 530 (as illustrated in FIG. 5). Leaving the opening 530 partially open may provide for a controlled withdrawal of the extension cord 510 from the cord bag 500. For example, it may be desired that only a portion of the extension cord 510 be removed from the cord bag 500. In an exemplary implementation, to remove a portion of the extension cord 510, a user could partially open the opening 530, and pull on the first end 512 until the desired portion of the extension cord 510 is removed. Thus, the cord bag 500 may allow for a specific length of the extension cord 510 to be withdrawn as desired.

It should be understood that both ends of the cord bag 500 may operate on essentially the same principle. Therefore, embodiments and examples given referring to the first opening 530 may be interpreted as applying to the second opening 540 as well.

Figure 6:
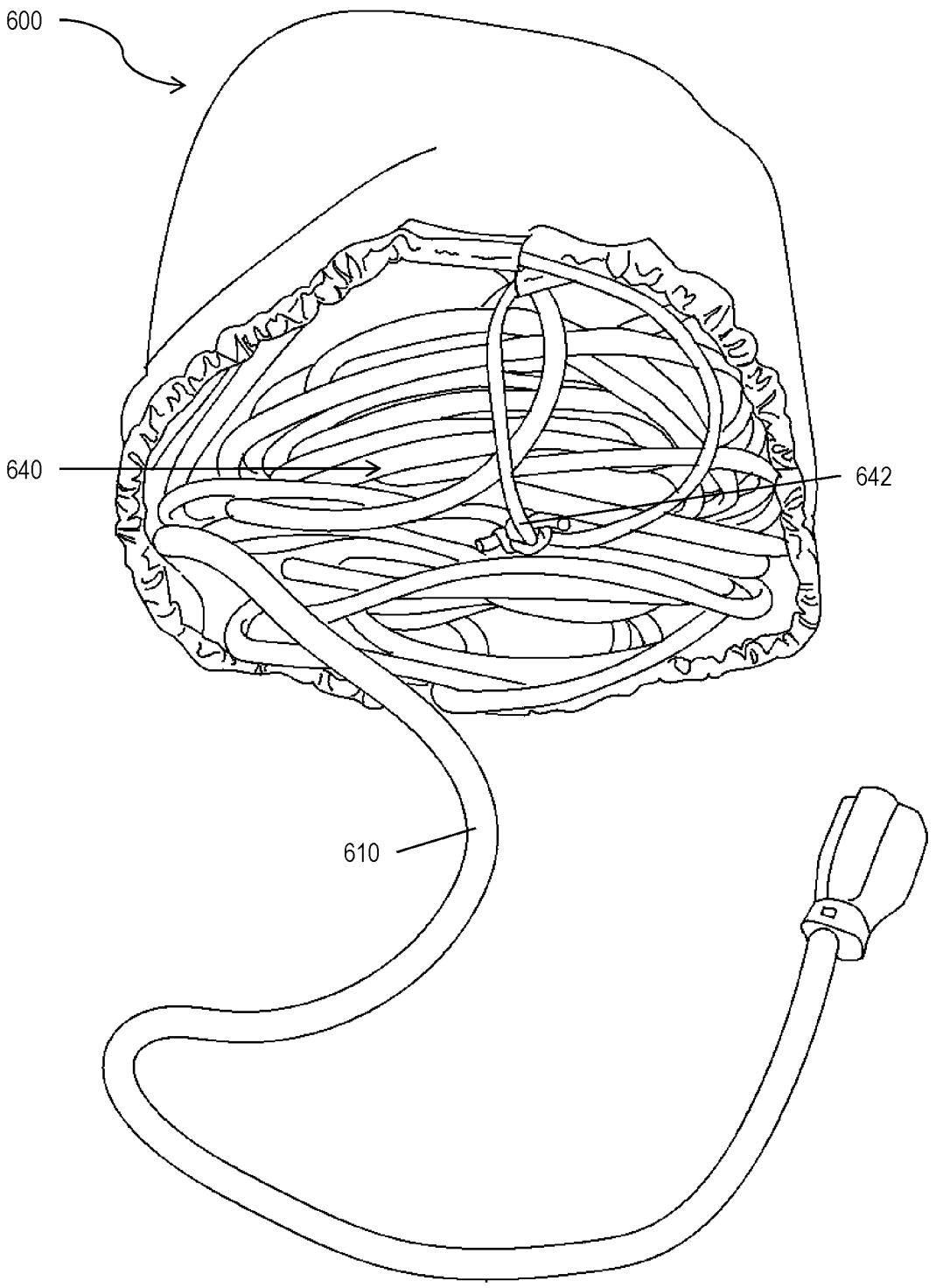
FIG. 6 illustrates a cord bag having an opening of a cord bag that is fully opened.

In other embodiments, the opening may be completely opened. FIG. 6 illustrates the cord bag 600 with an opening 640 through which a portion of the extension cord 610 extends, with another portion of the extension cord 610 being positioned within the cord bag 600. In the illustrated configuration, the opening 640, which is adjustable by a draw string 642, is completely open. With the opening 640 completely open, the illustrated configuration allows for rapid removal of the extension cord 610. For example, an entire portion of the extension cord 610 may be removed at once by fully opening the opening 640 and withdrawing the entire portion of the extension cord 610. Fully opening the opening 640 also may allow for throw-bag deployment, in which requires the cord is freely removed from the cord bag as the bag travels when thrown. The cord bag 610 thus allows for versatile deployment capabilities, instead of restricting cord deployment to a single method (e.g., user pulling).

Figure 7:
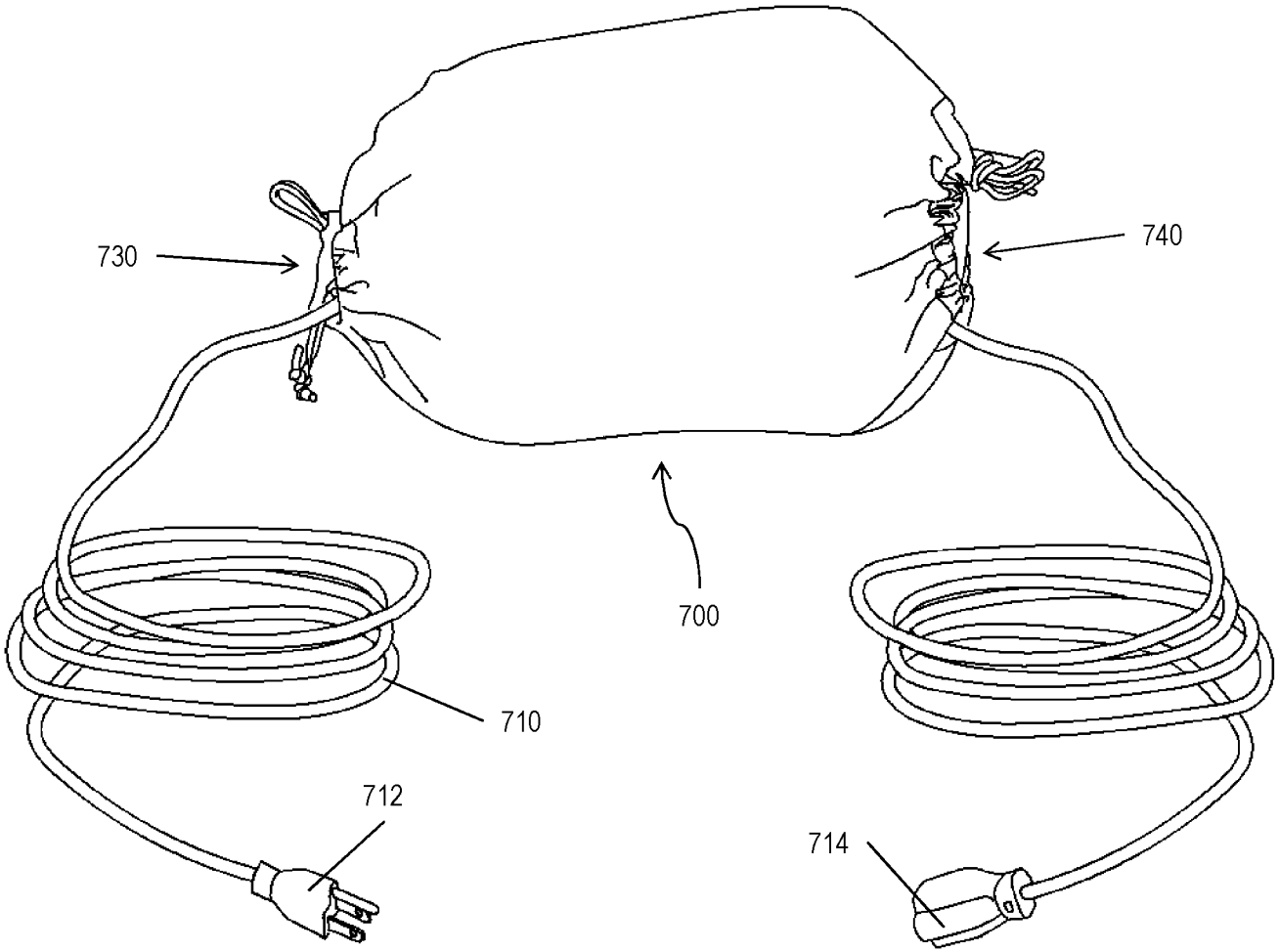
FIG. 7 illustrates a cord bag having a cord contained therein, with ends of the cord partially removed.

FIG. 7 illustrates a cord bag 700 with openings 730 and 740 on either side of the cord bag 700. An extension cord 710 is positioned within the bag, with a portion of the extension cord 710, including a first end 712, passing through and extending from one opening 730, and another portion of the extension cord 710, including a second end 714, passing through and extending from the other opening 740. FIG. 7 illustrates that the ends of the extension cord 710 stored within the bag 700 may be selectively removed independently of each other. It may be desirable to have differing lengths of the extension cord 710 available or removed from the bag 700 at a given time. For example, in one embodiment, the cord bag 700 may include a power strip, plugged into the second end 714, with multiple ports for various plugs. The first end 712 may be plugged into a power supply. To keep an area neat and reduce hazards, the cord bag 700 may be placed in a convenient location, and any excess extension cord 710 may remain contained in the cord bag 700. In some embodiments, referring to FIG. 8, one end of the extension cord 810 stored within the cord bag 800 may be completely removed from its compartment, while the other end may be less than completely removed from its compartment.

Figure 8:
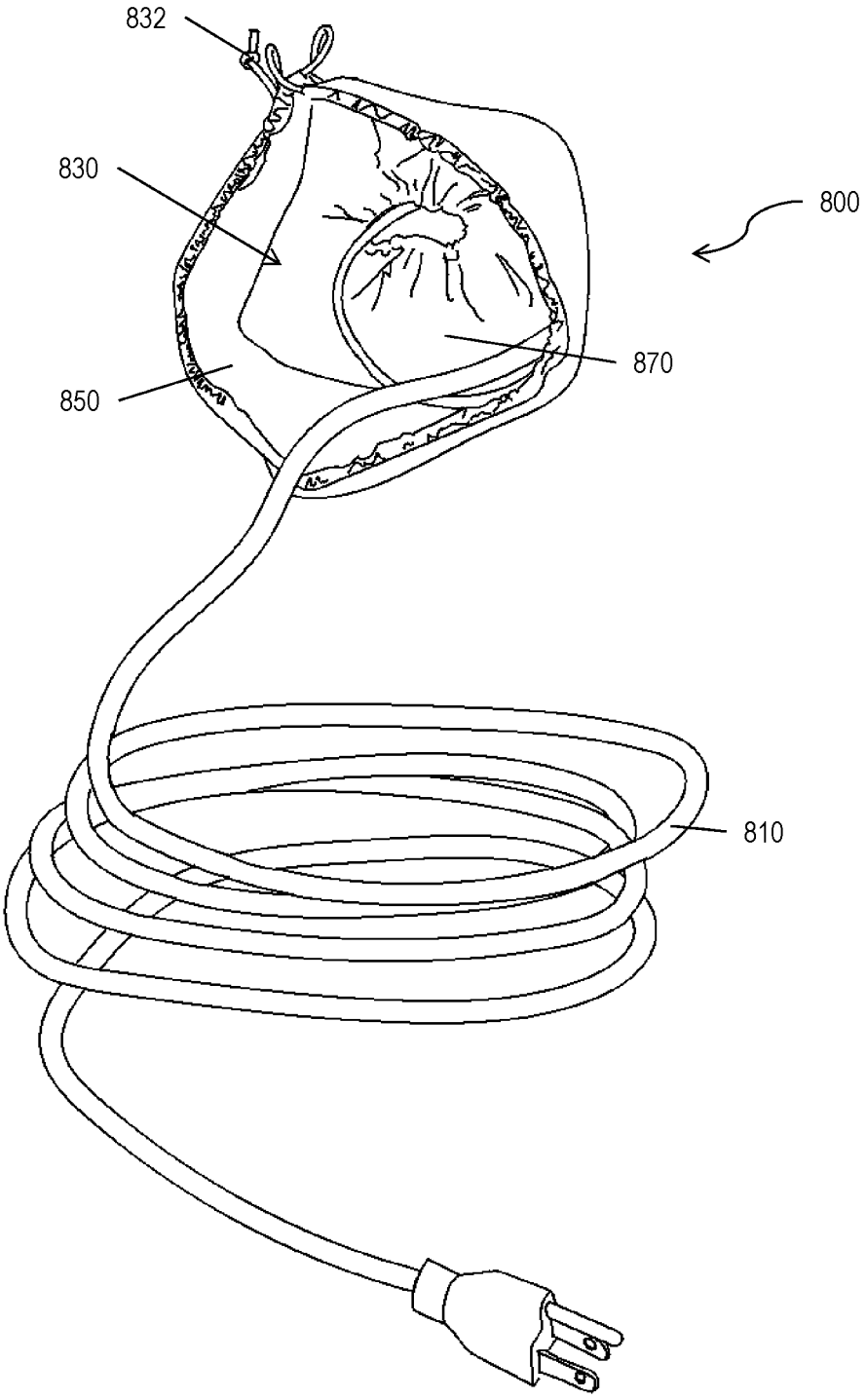
FIG. 8 illustrates a cord bag containing a cord with one end of the cord fully removed from the bag.
Figure 9:
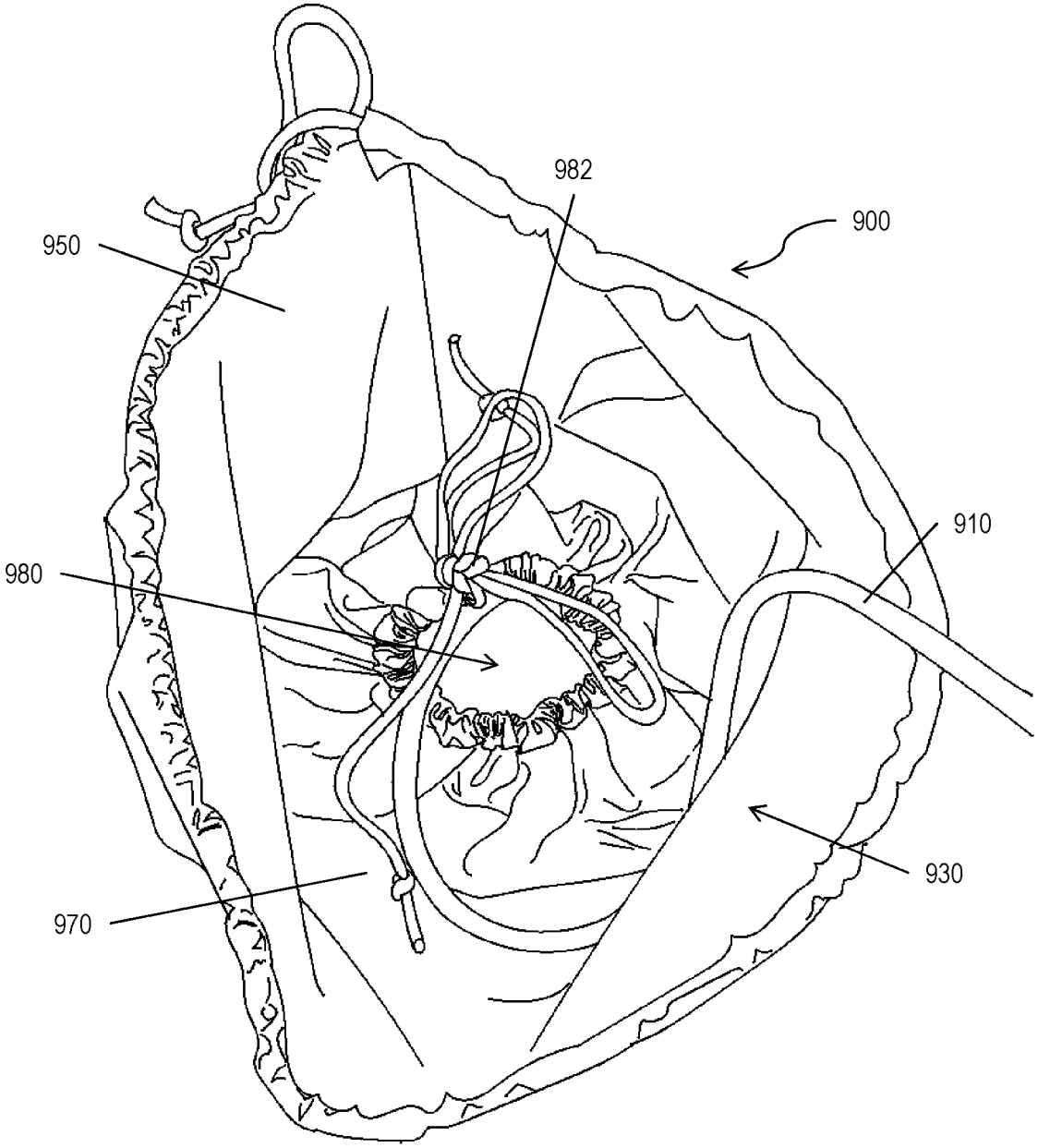
FIG. 9 illustrates a cord bag having a divider in an internal portion of the cord bag.

FIG. 8 and FIG. 9 illustrate exemplary internal configurations of some of the disclosed embodiments. In FIG. 8, a cord bag 800 includes an opening 830 which is closable by a draw string 832. The cord bag 800 includes a compartment 850, which is accessible through the opening 830. The cord bag 800 may include a corresponding compartment on an opposite side of the cord bag 800, accessible from an opening on the opposite side of the cord bag 800. The compartments of the cord bag 800 may be separated by a divider 870, which, in the illustrated embodiment, is placed within the cord bag 800 directly between opening 830 and a corresponding opening on an opposite side of the bag.

Referring to FIG. 9, the bag 900 includes a divider 970 which has a divider opening 980. The divider 970 is placed inside of the body of the cord bag 900 between opening 930 and an opening on the other side of the cord bag 900. The divider 970 separates compartment 950 from a corresponding compartment. The divider opening 980 is configured to allow at least a portion of the extension cord 910 to pass through the divider 970. The illustrated divider opening 980 is placed substantially in the center of the divider 970, such that the divider opening 980 is axially aligned with an axis passing through the opening 930 and another corresponding opening on the opposite side of the bag, although the divider opening 980 could be positioned at any location on the divider 970.

In some instances, as shown, the size of the divider opening 980 is adjustable with a draw string 982 (or cinch cord), although in other instances the divider opening 980 is of a fixed size, and may be created from a rigid material (e.g., plastic). For embodiments that include a divider opening which is adjustable in size, those skilled in the art will recognize that the size divider opening 980 may be adjusted by means other than a draw string 982 or cinch cord (e.g., hook and loop connectors, folding material, zipper(s), adjustable rigid partition(s)). In some instances, the divider 980 is adapted to keep portions of the extension cord 910 stored in one compartment of the cord bag 900 from intermingling and becoming tangled with other portions of the extension cord 910 stored in another compartment of the cord bag 900.

The divider 970 may be located in any position along the length of the cord bag 900 (i.e., centrally, or more proximate one side than the other side). The position of the divider 970 within the cord bag 900 determines roughly the relative amount of cord 910 that may be stored in the compartments of the cord bag 900, which compartments are separated at least partially by the divider 970. In some embodiments, the divider 970 is located substantially centrally, about 50% along the axial length of the cord bag 900. In other embodiments, the divider 970 may be located in a non-central location, such as to separate the interior chambers disproportionately about 90%/10%, or 80%/20%, 70%/30% or by another amount, along the axial length of the cord bag 900. In some instances, the divider 970 is in a fixed location with respect to the cord bag 900. In other instances, the position of the divider 970 within the cord bag 900 is adjustable, allowing for variable dividing of the interior volume of the cord bag 900 apportioned to the compartments within the cord bag 900. The position of the divider 970 may be adjustable in a variety of ways (e.g., hook and loop connection, snaps, and/or another fastening surface and/or component).

The length of cord 910 stored in each compartment created by the divider 970 may be non-uniform. For example, in some embodiments, each compartment may include the same length of cord 910 (e.g., approximately 50% of the cord in each compartment). In other embodiments, one compartment may include 40% of the cord 910 while the other compartment includes 60% of the cord 910; other disproportionate percentages of the cord 910 may be implemented.

In some embodiments, the divider 970 may be an integral part of the cord bag 900. For example, the divider 970 may be sewn into the cord bag 900. Other examples include gluing, heat welding and/or otherwise permanently fastening the divider 970 into the cord bag 900. In other embodiments, the divider 970 may be selectably removable from the cord bag 900. For example, the divider 970 may include a zippered connection with the cord bag 900. Other examples include a hook and loop connections (e.g., Velcro), tape, hooks, snaps and/or other fasteners positioned between the divider 970 and the cord bag 900.

Figure 10:
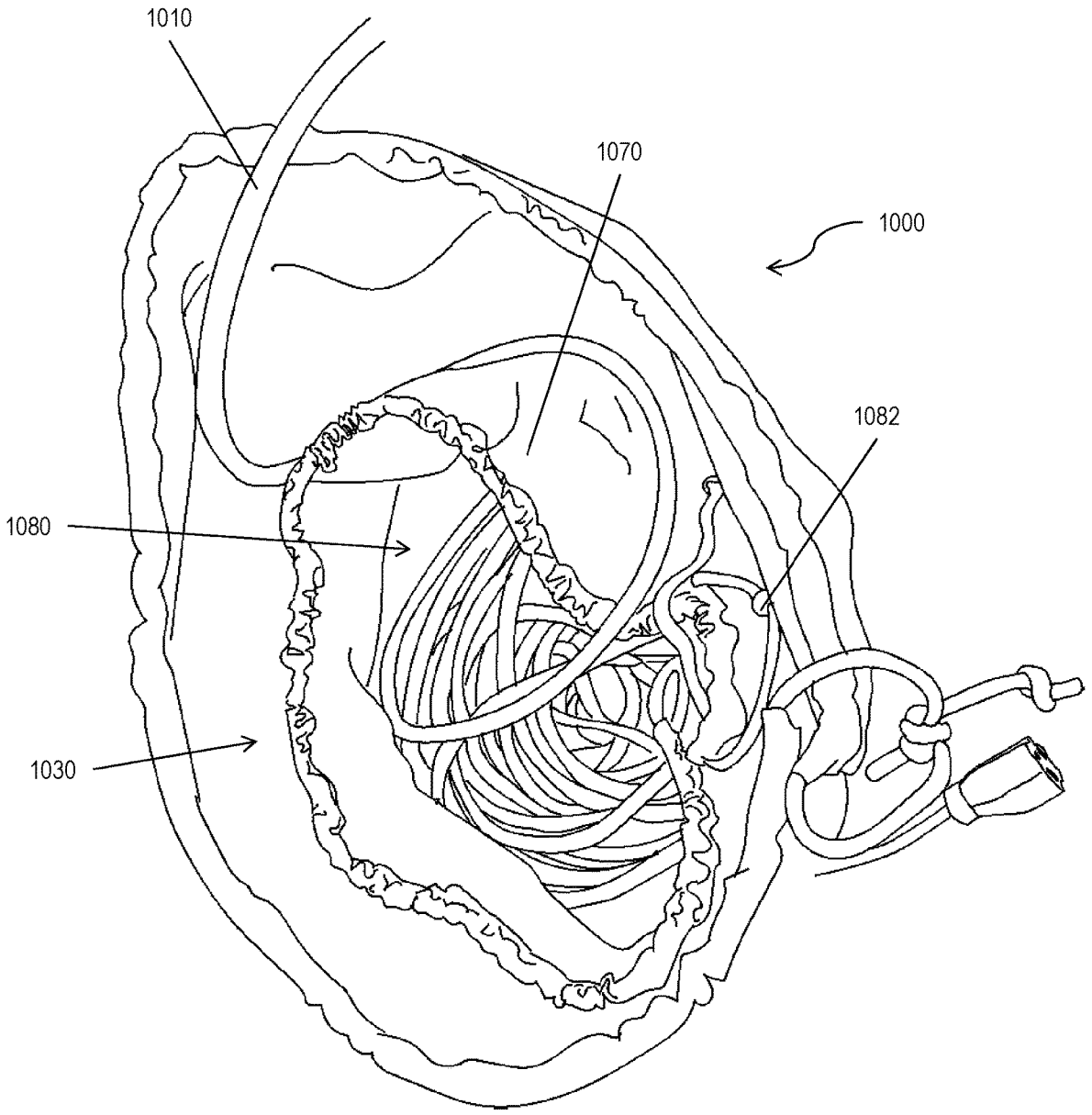
FIG. 10 illustrates a cord bag having an internal divider that is illustrated as being opened.

FIG. 10 illustrates an embodiment of a cord bag 1000 where the divider opening 1080 of the divider 1070 is adjusted, by a draw string 1082, to a fully open position. A fully open configuration may allow for complete removal of the extension cord 1070 through either end the cord bag.

The adjustable functionality of the divider opening 1080 may also aid users in the process of quickly storing cords in a tangle-free manner. For example, a user may use a process of their choice to loop, coil, and/or stack an entire cord 1010 for storage within the cord bag 1000. The user may then fully open the divider opening 1080 and an opening 1030 and place the coiled cord 1010 within the interior of the cord bag, with a portion of the coil in one compartment and another portion of the coil in the other compartment. With a portion of the cord 1010 passing through the divider opening 1080, the user may close the divider opening 1080 to separate the two portions of the coiled cord 1010 within the cord bag 1000.

The cord bag may be deployed using a variety of techniques. For example, the cord bag may be held or otherwise attached to a user while the cord is being deployed. Additionally, in some examples one or both ends of the cord may be attached to a location or held by a first user, while a second user travels away from the first user, holding the cord bag. In other embodiments, the cord bag may be thrown, with one or both ends of the cord held by the user, or otherwise attached in a desired location. Still other embodiments include a cord bag that is anchored in one place.

The foregoing description pertains to bags and bag assemblies that may facilitate tangle-free storage of cords, ropes, cables, and other long and flexible members. Although the foregoing description has primarily concerned cord bags with a generally cylindrical elongated geometry, other embodiments of the invention include cord bags with other geometries. For example, a cord bag may have a rectangular geometry. Additionally, even though the foregoing description has primarily concerned cord storage bags, other embodiments of the invention include other storage devices comprised of non-flexible material (e.g., boxes, cans, buckets).

Furthermore, the embodiments of the present disclosure are not limited to the features described herein. For example, the interior chambers of a cord storage bag may include fasteners, pockets, loops, hooks, and/or other attachment components for securely holding fuses, explosives, power strips, tools and/or other components.

In addition, certain embodiments of a cord bag described herein (particularly those described in FIG. 1 through FIG. 5) include a strap, which may facilitate ease of use of the cord bag. Embodiments of a cord bag, according to the present disclosure, need not necessarily include a strap (see FIG. 6 through FIG. 10), and embodiments of a cord bag may include additional or alternative features to facilitate ease of use, safety, and/or user comfort (e.g., padding).

Many disclosed embodiments of the inventive cord bags include two openings (one on each side) and a single divider placed between the openings with a single hole in the divider. It will be appreciated, however, that the present disclosure is not limited to this configuration. Other embodiments of a cord bag include more than two openings (e.g., three or four openings) and/or include more than a single divider between the two openings (e.g., two or more dividers, each with a selectably closable hole), thus separating the cord bag into more than two compartments for cord storage. Yet other embodiments of a cord bag include one or more divider(s) with more than one hole placed into one or more of the divider(s).

Elements described in relation to any embodiment depicted and/or described herein may be substituted for or combined with elements described in relation to any other embodiment depicted and/or described herein. For example, a cord bag may include one opening which is closable with a cinch cord, one opening which is closable with a Velcro strip, and an internal divider with an internal divider opening which is fixed to a size of 2.5 inches and placed in the center of the internal divider.

Reference has been made to the drawings to describe various aspects of exemplary embodiments of the invention. It is understood that the drawings are diagrammatic and schematic representations of such exemplary embodiments, and are not limiting of the present invention, nor are any particular elements to be considered essential for all embodiments or that elements be assembled or manufactured in any particular order or manner. No inference should therefore be drawn from the drawings as to the necessity of any element. In the foregoing description, numerous specific details are set forth in order to provide a thorough understanding of the present invention. It will be obvious, however, to one of ordinary skill in the art that the present invention may be practiced without these specific details. In other cases, well-known aspects of cord storage processes, methods and related devices, as well as general manufacturing techniques and the like, are not described in detail herein in order to avoid unnecessarily obscuring the novel aspects of the present invention.

What is claimed is:

1. A bag for storing and removing a cord, the bag comprising:

a bag body composing a first compartment and a second compartment, the first compartment being at least partially separated from the second compartment by an internal divider, wherein an outer surface of the first compartment defines a first opening and an outer surface of the second compartment defines a second opening, wherein the internal divider is positioned directly between the first opening and the second opening, and wherein the internal divider completely separates the first compartment from the second compartment except for a single hole that is positioned on and that passes through the internal divider, and wherein the single hole is surrounded by a cinch cord positioned around a perimeter diameter of the single hole, within the bag body, between the first compartment and the second compartment inside of the bag body, whereby the perimeter diameter of the single hole of the internal divider is adjustable by the cinch cord between an open position and a closed position and such that the single hole has an expandable perimeter diameter; and wherein each of the first and second opening is configured with a closing mechanism for selectively switching the first and second opening between an open configuration and a closed configuration, wherein the bag is configured to provide access to a cord in the bag from both the first and second openings.

2. The bag of claim 1, wherein the hole of the internal divider is axially aligned with an axis passing through the bag, the first opening, and the second opening.

3. The bag of claim 1, wherein the closing mechanism is a cinch cord.

4. The bag of claim 1, wherein the bag further includes the cord positioned in the bag with a portion of the cord contained at least partially within the first compartment and at least partially within the second compartment.

5. The bag of claim 1, further comprising a fastener, the fastener being configured to selectably receive and secure an end of the cord.

6. The bag of claim 5, wherein the fastener is positioned on an exterior surface of the bag.

7. The bag of claim 5, wherein the fastener is positioned on an interior surface of the bag.

8. A bag for storing and removing a cord, the bag comprising:

a bag body composing a first compartment and a second compartment, the first compartment being completely separated from the second compartment by an internal divider except for an expandable hole that passes through the internal divider, the expandable hole having a perimeter diameter that is expandable with a cinch cord positioned at the perimeter diameter of the expandable hole, within the bag body, between the first compartment and the second compartment, and such that the diameter of the expandable hole of the internal divider is adjustable by the cinch cord between an open position and a closed position, wherein an outer surface of the first compartment defines a first opening and an outer surface of the second compartment defines a second opening, wherein the internal divider is positioned directly between the first opening and the second opening, the expandable hole of the internal divider being axially aligned with an axis passing through the first opening and the second opening, and wherein each of the first and second opening is configured with a cinch cord for selectively switching the first and second opening between an open configuration and a closed configuration, wherein the bag is configured to provide access to a cord in the bag from the first and second openings.

9. The bag of claim 8, further comprising a fastener, the fastener being configured to selectable receive and secure an end of the cord.

10. The bag of claim 9, wherein the fastener is positioned on an exterior surface of the bag.

11. The bag of claim 10, wherein the fastener is positioned on an interior surface of the bag.

* * * * *